US005286111A

United States Patent [19]

Brembilla

[11] Patent Number: 5,286,111

[45] Date of Patent: Feb. 15, 1994

[54] BAG TIES AND MANUFACTURE THEREOF

[75] Inventor: Roberto Brembilla, Milan, Italy

[73] Assignee: David J. Instance Limited, United Kingdom

[21] Appl. No.: 686,362

[22] Filed: Apr. 17, 1991

[30] Foreign Application Priority Data

Aug. 31, 1990 [GB] United Kingdom ..... 9019029.9
Nov. 12, 1990 [EP] European Pat. Off. ..... 90312329.7

[51] Int. Cl.[5] ..... B65D 33/28

[52] U.S. Cl. ..... 383/62; 383/71; 24/30.5 P

[58] Field of Search ..... 383/62, 71, 89; 24/30.5 R, 30.5 P; 206/440, 441

[56] References Cited

U.S. PATENT DOCUMENTS

| | | | |
|---|---|---|---|
| 684,573 | 10/1901 | Howe | 383/62 |
| 3,519,196 | 7/1970 | Paxton | 383/62 |
| 3,889,872 | 6/1975 | Lin . | |
| 4,008,851 | 2/1977 | Hirsch | 383/62 |
| 4,643,305 | 2/1987 | De Roure Olivier . | |
| 4,744,591 | 5/1988 | Instance . | |
| 4,854,735 | 8/1989 | Rutledge | 383/71 X |
| 4,902,141 | 2/1990 | Linnewiel | 383/89 |
| 4,906,108 | 6/1990 | Herrington et al. . | |
| 4,911,563 | 3/1990 | Ciani | 383/89 |
| 4,933,043 | 6/1990 | Instance . | |
| 5,040,904 | 8/1991 | Cornwell | 383/62 X |

FOREIGN PATENT DOCUMENTS

| | | | |
|---|---|---|---|
| 883916 | 12/1961 | United Kingdom . | |
| 1333578 | 10/1973 | United Kingdom . | |
| 1590967 | 6/1981 | United Kingdom . | |
| 2173770 | 10/1986 | United Kingdom | 383/71 |
| 2186545 | 8/1987 | United Kingdom . | |
| 2199010 | 6/1988 | United Kingdom . | |

*Primary Examiner*—Allan N. Shoap
*Assistant Examiner*—Jes F. Pascua
*Attorney, Agent, or Firm*—Hill, Steadman & Simpson

[57] ABSTRACT

The invention provides a self-adhesive tie for a bag, the tie comprising a folded length of tie material, an adhesive layer for adhering the folded length to a bag, and a backing of release material covering the adhesive layer. The invention also provides a method of making a succession of self-adhesive ties for bags, the method comprising the steps of: (a) disposing a succession of folded lengths of tie material on a web, the web including a backing of release material and each folded length being adhered directly or indirectly to the backing of release material; and (b) cutting the folded lengths of tie material and the web to form a succession of ties for bags.

12 Claims, 2 Drawing Sheets

BAG TIES AND MANUFACTURE THEREOF

BACKGROUND OF THE INVENTION

The present invention relates to a tie for a bag and to a method of making a succession of ties for bags.

DESCRIPTION OF THE PRIOR ART

In the past, ties for bags have comprised lengths of wire coated with paper or plastics with an interconnected series of ties being provided loosely in combination with the bags. This arrangement has a disadvantage in that the ties and bags must be separately packed. An attempt to overcome this disadvantage resulted in the provision of ties integral with the material of the bags, the ties comprising lengths of plastic disposed along one edge of the bag. However, this neccessitated a complete modification to the bag manufacturing apparatus.

There is a need for a tie for a bag and a method of manufacture thereof which provides ties which can easily and conveniently be provided in combination with the bags but without requiring modification of the bag or its manufacturing apparatus.

SUMMARY OF THE INVENTION

Accordingly, the present invention provides a self-adhesive tie for a bag, the tie comprising a folded length of tie material, an adhesive layer for adhering the folded length to a bag, and a backing of release material covering the adhesive layer.

In one preferred embodiment, the adhesive layer comprises a pressure-sensitive adhesive which coats a rear surface of the folded length. In another preferred embodiment, the tie further comprises a support piece on which the folded length is disposed and the adhesive layer may be a pressure-sensitive adhesive which coats a rear surface of the support piece.

The support piece may in use be adhered to a bag. In a preferred embodiment the support piece is a piece of self-adhesive paper which has a surface covered with a pressure-sensitive adhesive and is carried on a backing of release material. The release material may be stripped off from the self-adhesive support piece whereby the support piece can then be adhered by the pressure-sensitive adhesive surface to a bag.

The present invention also provides a method of making a succession of self-adhesive ties for bags, the method comprising the steps of:

(a) disposing a succession of folded lengths of tie material on a web, the web including a backing of release material and each folded length being adhered directly or indirectly to the backing of release material; and (b) cutting the folded lengths of tie material and the web to form a succession of ties for bags.

BRIEF DESCRIPTION OF THE DRAWINGS

Embodiments of the present invention will now be described by way of example only with reference to the accompanying drawings, in which.

DESCRIPTION OF THE PREFERRED EMBODIMENTS

Figure 1:
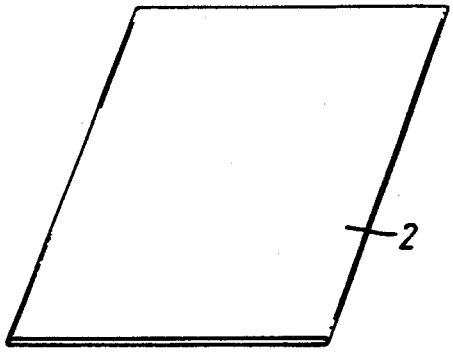
FIG. 1 is a perspective plan view of a length of tie material to be folded and incorporated into a plurality of ties in accordance with a first embodiment of the present invention.
Figure 2:
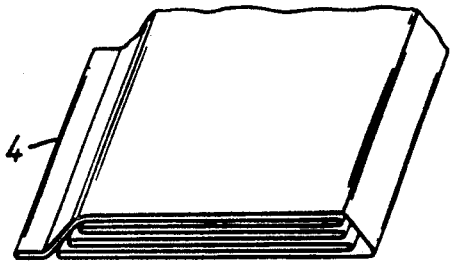
FIG. 2 is an enlarged perspective plan view of part of the tie material of FIG. 1 after having been folded.

Referring to FIG. 1, there is shown a flattened tube 2 of plastics sheet material, such as polyethylene, which is intended to form the tie material in the ties of the present invention. Typically, the flattened tube 2 has dimensions of 200×200 mm. The tube 2 is folded, for example in an automatic folding machine, about a series of longitudinal fold lines to form a folded tube 4 which is shown in FIG. 2. The folded tube 4 is shown exaggerated in thickness but it will be seen that it consists of a plurality of folds whereby the transverse width of the folded tube 4 is considerably less than the transverse width of the original flattened tube 2.

Figure 3A:
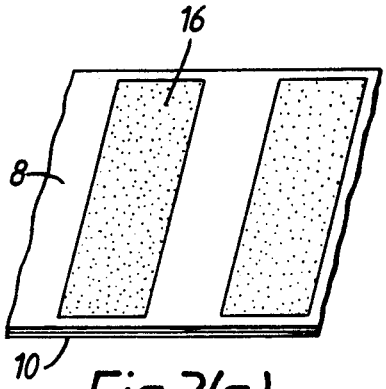
FIGS. 3(*a*), 3(*b*), 3(*c*) and 4 illustrate a method of making ties in accordance with the present invention.
Figure 3B:
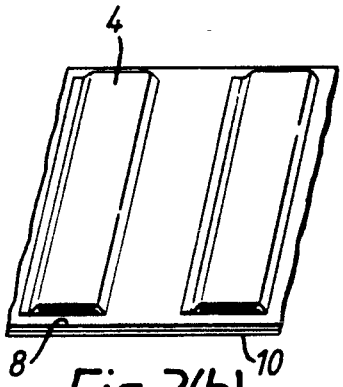
Figure 3C:
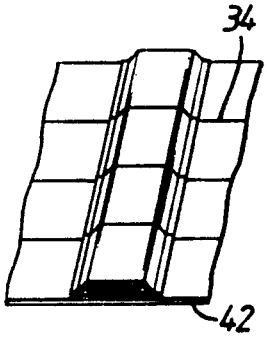
Figure 4:
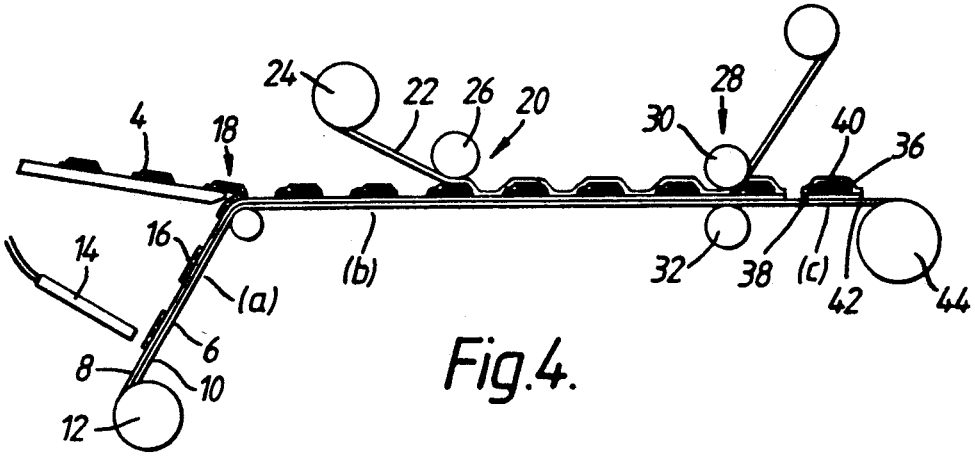

Referring to FIGS. 3 and 4, there is shown a method of producing ties in accordance with the present invention. In accordance with the method, a support web 6 comprises a self-adhesive paper web 8 coated on its rear surface with a pressure-sensitive adhesive and carried on a backing 10 of release material. The support web 6 is fed out from a reel 12 thereof and fed under an adhesive applicator 14 which, as is shown in FIG. 3(*a*), applies a succession of layers 16 of adhesive, such as water-soluble or hot melt adhesive, transversely across the support web 6. In FIG. 4 the location of the assembly in FIG. 3(*a*) is indicated. The combined assembly then passes to a tie material applying station 18 at which a succession of the folded tubes 4 of tie material are applied each to a respective layer 16 of adhesive. Each folded tube 4 of tie material extends transversely across the support web 6 and overlies the layer 16 of adhesive. The resultant assembly is shown in FIG. 3(*b*) and the location of such assembly is shown in FIG. 4. The combined assembly then passes to a laminar material applying station 20 at which a laminar material 22 is fed out from a reel 24 thereof and urged by a roller 26 against the upper surface of the combined assembly of the folded tubes 4 on the support web 6. The laminar material 22 comprises a self-adhesive plastics material, such as polypropylene, which is coated on one surface with a pressure-sensitive adhesive. The laminar material 22 is adhered over the folded tubes 4 and the support web 6 by its pressure-sensitive adhesive surface. The combined assembly then passes to a die-cutting station 28 at which the combined assembly is passed between an upper die-cutting roller 30 and a lower backing roller 32. At the die-cutting station 28 the composite web is slit longitudinally with one or more longitudinal slits 34, as shown in FIG. 3(*c*), thereby to cut each folded tube 4 into a plurality of folded lengths 36 of tie material, each of which is disposed on a respective support piece 38 which has been cut from the support web 6 and each of which is covered by a laminar material piece 40 which has been cut from the laminar material 22. The opposed ends of the folded tube 4 are cut away and are removed together with the waste of the support web 6 and the laminar material 22. The resultant assembly is shown in FIG. 3(c) wherein a plurality of ties in accordance with the present invention are disposed on respective slit lengths 42 of release material 10 and are longitudinally oriented with respect to each other. The resultant plurality of lengths 42 of release material 10 carrying the respective successions of ties are wound up onto respective reels 44.

Figure 5:
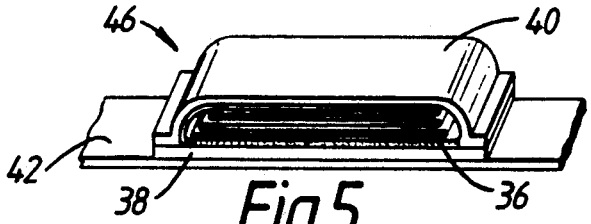
FIG. 5 is a perspective plan view of a tie for a bag in accordance with the first embodiment of the present invention.

The resultant tie 46 for a bag in accordance with the present invention is shown in FIG. 5. It will be seen that the resultant tie 46 comprises the self-adhesive support piece 38 which is carried -on the strip 42 of release material and has adhered thereto in succession the folded length 36 of tie material, which is a folded, continuous annular loop, and the laminar material portion 40. It will be seen that the laminar material portion 40 extends past both ends of the folded length 36 of tie material and the two free ends of the laminar material portion 40 are adhered by the adhesive surface thereof and/or the adhesive layer 16 to the support piece 38. The folded length 36 of tie material is securely retained between the laminar material portion 40 and the support piece 38.

When it is desired to apply the ties to bags, the strip 42 of release material is pulled away from the support piece 38 and the support piece 38 is adhered by its adhesive surface to a bag. This can be done either manually or at high speed using a high speed labelling apparatus. When it is desired to utilise the tie, the laminar material portion 40 is pulled away from the support piece 38 and this releases the folded length 36 of tie material. Alternatively, the folded length 36 of tie material may simply be pulled out from between the laminar material portion 40 and the support piece 38. The folded length 36 of tie material can then be unfolded to form a loop and this can be used, if desired by forming a slip knot, to tie the neck of the bag.

In alternative embodiments, the folded length of tie material does not require to be a loop but can be a simple length which is free at both ends.

Figure 6:
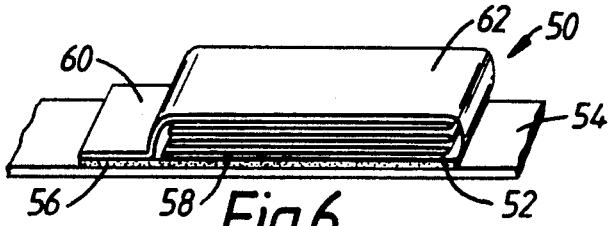
FIG. 6 is a perspective view of a tie for a bag in accordance with a second embodiment of the present invention.

A second embodiment of a tie 50 for a bag in accordance with the invention is shown in FIG. 6. In this embodiment, the tie consists simply of a folded length 52 of tie material, this being of the same construction and same material as the folded length shown in FIG. 5 relating to the first embodiment. In contrast to the first embodiment, no laminar material portion- overlies the folded length 52. The folded length 52 is retained in its folded condition by the adhesion of the rear surface of the folded length 52 directly to a backing 54 of release material by means of a layer 56 of pressure-sensitive adhesive. The rear surface of the folded length 52 comprises the rear surface of a rearmost body portion 58 over which a succession of folded lengths are disposed and the rear surface of an overlapping flap 60 which is disposed adjacent the rearmost portion 58 and retains the folded length 52 in its folded condition. Thus it will be seen that the second embodiment also does not require a support piece to which the folded length is adhered but rather the folded length is coated on its rear surface with a pressure-sensitive adhesive and is adhered directly to a release material.

The bag tie 50 of the second embodiment may be made by substantially the same method which is described with reference to FIG. 3 and 4. The method is modified in that the support web simply comprises the backing 54 of release material and the self-adhesive paper support web is omitted whereby the folded tubes 4 are applied directly to the backing 54 of release material to which adhesive layers have already been applied. In addition, laminar material is not applied over the assembly of folded tubes on the web. The folded tubes are simply die-cut as shown in FIGS. 3 and 4.

When it is desired to apply the bag tie 50 to a plastic bag, the bag tie 50 is removed from the backing 54 of release material and this strips off from the backing 54 the layer 56 of pressure-sensitive adhesive together with the bag tie 50 and the bag tie 50 can be adhered to a plastics bag by the layer 56 of pressure-sensitive adhesive. The bag tie is applied near to the mouth of the bag. When it is desired to tie up the bag by use of the bag tie 50, either the bag tie 50 can be separated from the bag by separation of the tie and the bag at the adhesive interface or alternatively the folded portions of the bag tie can be pulled out from between the rear most portion 58 and the top most portion 62 and used to tie the bag.

The embodiment of FIG. 6 may be modified by providing a laminar material portion over the folded length. The laminar material portion has the same construction and is manufactured in the same manner as that of the embodiment of FIGS. 1 to 5.

Figure 7:
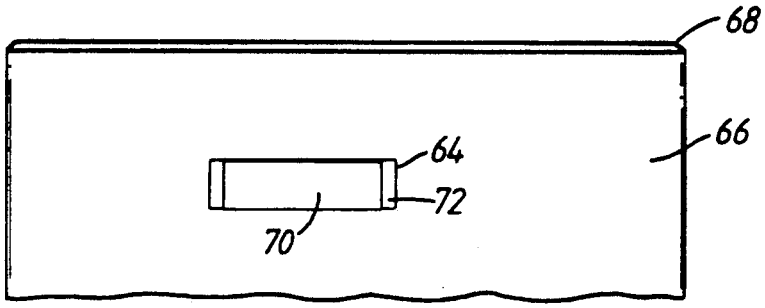
FIG. 7 is a perspective view of a tie for a bag in accordance with a third embodiment of the present invention when adhered to plastics bag.
Figure 8:
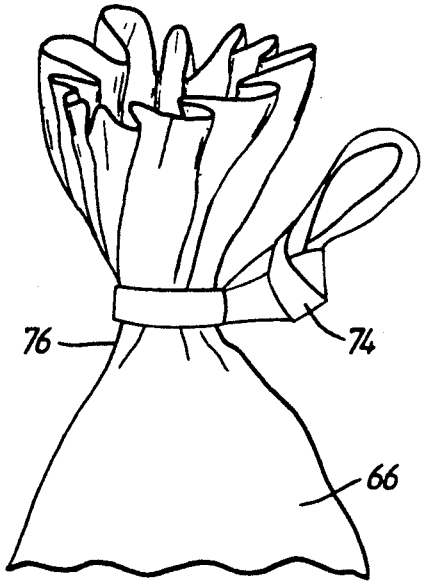
FIG. 8 is a perspective view of the bag tie/plastics bag assembly shown in FIG. 7 after the tie has been employed to seal the top of the bag.

A further embodiment of a bag tie in accordance with the present invention is illustrated with reference to FIGS. 7 and 8. FIG. 7 shows the bag tie 64 adhered to a plastics bag 66 in the region of the mouth 68 thereof. The bag tie 64 has a similar construction to that shown in FIG. 6 but is modified in that instead of the folded length 70 being adhered directly to a backing of release material by a layer of pressure-sensitive adhesive the folded length 70 is adhered by a layer of adhesive to a support piece 72 which is coated on its rear surface with a pressure-sensitive adhesive. The support piece 72 has a construction which is similar to that shown in FIG. 5. As will be clear to the man skilled in the art, the bag tie 64 of the third embodiment can be made by employing the method illustrated in FIGS. 3 and 4 but with the omission of the laminar material. The bag tie 64 of the third embodiment has a construction similar to that of the first embodiment shown in FIG. 5 but with the omission of the laminar material portion.

As is clear from FIG. 7, the bag tie is adhered by the pressure-sensitive adhesive surface of the support piece 72 to the plastics bag in the region of the mouth 68 thereof. When it is desired to close the bag, the folded length 70 is unfolded and then tied to form a slip knot 74 which is tightened so as to close the neck 76 of the bag 68. The support piece 72 can remain adhered by its self-adhesive surface to the bag 66.

What I claim is:

1. A self-adhesive tie for a bag, the tie comprising a support piece, a continuous annular loop of tie material, which is folded to form a folded length, being disposed on the support piece, said support piece having a rear surface being coated with an adhesive layer of pressure-sensitive adhesive for adhering the folded length to a bag, a backing of release material covering the adhesive layer, and a laminar material comprising a self-adhesive plastic material having a coating of pressure-sensitive adhesive, said laminar material extending over the folded length and being adhered to the backing of release material and the support piece.

2. A tie for a bag according to claim 1, wherein the self-adhesive plastic material is a polypropylene.

3. A tie for a bag according to claim 1, wherein the folded length is comprised of a plastic sheet material.

4. A tie for a bag according to claim 3, wherein the plastic material is polyethylene.

5. A tie according to claim 1, wherein said folded length has more than two folds of the continuous annular loop.

6. A tie according to claim 1, wherein the support piece is a piece of paper.

7. A combination comprising a bag and a tie for the bag, the tie comprising a support piece, a continuous annular loop of tie material, which is folded to form a folded length, being disposed on the support piece, a laminar material comprising a self-adhesive plastic material having a coating of pressure-sensitive adhesive, said laminar material extending over the folded length and being adhered to the support piece, and an adhesive layer of pressure-sensitive adhesive coating a rear surface of the support piece, said tie being attached to the bag by the adhesive layer of the support piece adhering to the bag.

8. A combination bag according to claim 7, wherein the folded length has more than two folds of the continuous annular loop.

9. A combination according to claim 7, wherein the support piece is a piece of paper.

10. A combination according to claim 7, wherein the plastic material is polypropylene.

11. A combination according to claim 7, wherein the folded length is comprised of a plastic sheet material.

12. A combination according to claim 11, wherein the plastic material is polyethylene.

* * * * *